United States Patent [19]

Devine

[11] 4,175,510

[45] Nov. 27, 1979

[54] COFFERDAM

[76] Inventor: Thomas H. Devine, 147 Jefferson Ave., Chula Vista, Calif. 92012

[21] Appl. No.: 845,355

[22] Filed: Oct. 25, 1977

[51] Int. Cl.[2] ..... B63B 43/16

[52] U.S. Cl. ..... 114/227; 405/12

[58] Field of Search ..... 114/227; 61/34, 11, 61/12, 13, 14; 405/11-13

[56] References Cited

U.S. PATENT DOCUMENTS

| | | | |
|---|---|---|---|
| 3,094,964 | 6/1963 | Witten | 114/227 |
| 3,653,215 | 4/1972 | Crucet | 61/34 |
| 3,849,996 | 11/1974 | Mittleman | 114/227 |
| 3,857,249 | 12/1974 | Kelly | 114/227 |

FOREIGN PATENT DOCUMENTS

| | | | |
|---|---|---|---|
| 551098 | 11/1956 | Italy | 114/227 |

*Primary Examiner*—Trygve M. Blix
*Assistant Examiner*—D. W. Keen
*Attorney, Agent, or Firm*—Brown & Martin

[57] ABSTRACT

A cofferdam for closing off underwater openings in ships' hulls and the like includes a box-like structure having a flat wall of a size and configuration for covering a ship's openings, with peripheral walls for extending around the flat wall and around the opening for sealingly engaging the ship's hull and defining a chamber around the opening. Conduits are provided for communication with a pump for pumping fluid or water from the chamber of the cofferdam and for venting the dam either to atmosphere or the water for filling the cavity. Fastenings include J-bolts in one configuration for securing the cofferdam to grill work and the like inside a opening to a sea chest, and a hogging type rigging in another embodiment for securing where grill work and the like is not available. The cofferdam is constructed of wood for providing buoyancy in water and includes reinforcing bars extending across the face of the dam which are in the form of closed box beams for providing additional buoyancy.

11 Claims, 8 Drawing Figures

COFFERDAM

BACKGROUND OF THE INVENTION

The present invention relates generally to ship repairing and pertains particularly to cofferdams for permitting in the water or dockside repair of ocean going vessels.

Many water borne cargo vessels, such as sea going ships and the like, have openings in the hull below water line for communicating with the water. Such openings are for many purposes including drawing of water from the ocean for cooling and the like and for expelling water and other waste material into the ocean. Such openings are typically connected by conduits and the like to pumps and other equipment within the engine room and other compartments of the vessel. It is sometimes necessary to replace or repair some of the plumbing in and around such openings and leading to such openings. It is also frequently necessary to add plumbing to the ship which communicates to the outside of the hull, in which case it is necessary to cut a hole in the hull and mount suitable conduit means therein.

It is also frequently necessary to repair holes in the hull below the water line. These repairs and reconstructions can be readily accomplished in dry dock. However, dry docks are frequently not available or are available only after a long wait.

It has been known, for example, to close openings in a ship's hull by means of mattresses, sheets of plywood, and the like for purposes of permitting replacement of plumbing inside the ship and the like. However, such approach can be dangerous and is highly unsatisfactory in most instances. Such approach is also unsatisfactory where it is necessary to repair or replace grill work or to do cutting and welding in and around the opening in the hull.

Accordingly, it is desirable that some means be available for permitting dock side repair of hull openings and the like of sea going vessels.

SUMMARY AND OBJECTS OF THE INVENTION

Accordingly it is the primary object of the present invention to overcome the above problems of the prior art.

Another object of the present invention is to provide an improved cofferdam construction that permits rapid and efficient repair of vessels at dock side.

A further object of the invention is to provide an improved cofferdam for sealing below water openings in a vessel for permitting quick and easy repair of the vessel.

In accordance with the primary aspect of the present invention, a cofferdam includes a generally box like construction including peripheral walls for sealingly engaging a ship's hull and defining a chamber about an opening, and means for securing the cofferdam to the ship's hull. Means are provided for communicating with the cavity of the cofferdam for draining and venting the cavity.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENTS

Figure 1:
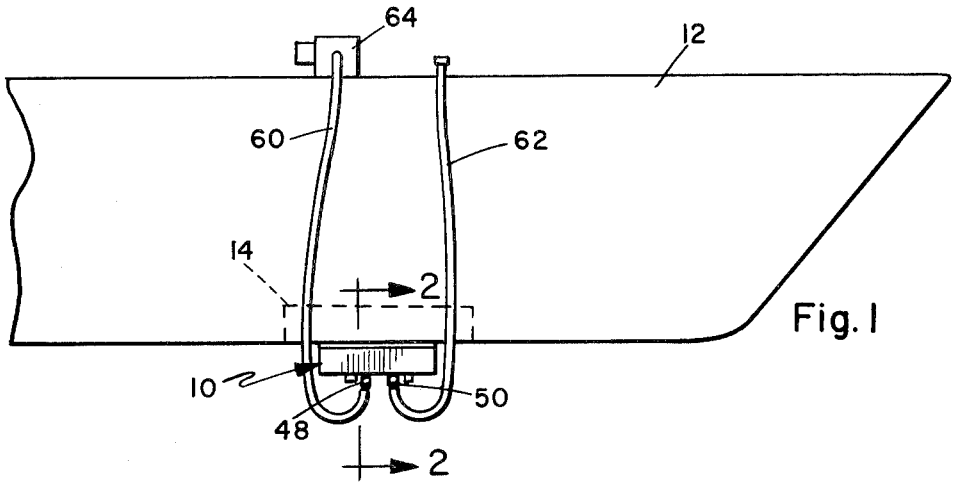
FIG. 1 illustrates a cofferdam secured to the hull of a vessel.
Figure 2:
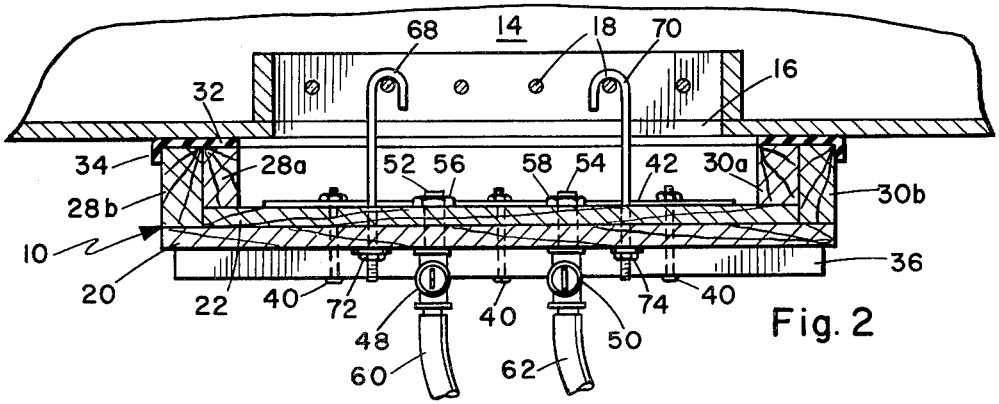
FIG. 2 is an enlarged sectional view taken on line 2—2 of FIG. 1.

Turning to FIG. 1 of the drawing, a cofferdam designated generally by the numeral 10 is attached to the hull of a vessel 12 beneath the water line thereof. The cofferdam is attached to the hull over an opening into a sea chest 14. A sea chest is simply a cavity or chamber attached to the hull of a ship below the water line and communicating externally thereof with the water, for obtaining water for condensors and the like and for venting steam and other fluids. The sea chest is normally connected by plumbing such as a plurality of pipes and valves to convey water for various purposes within the ship. As best seen in FIG. 2, an opening 16 communicates directly into the sea chest 14 and includes grill work comprising a plurality of grill members or the like 18 extending across the opening.

The cofferdam is of a generally box like configuration and, as illustrated, is of a generally rectangular configuration having a lid or top wall constructed of outer and inner sheets of marine plywood 20 and 22 laminated together and closely fit into and secured to end walls 24 and 26 and side walls 28 and 30. These side walls are each constructed respectively of inner and outer wall panels **28*a* and 28*b* and 30*a* and 30**b. These double wall panels are connected or secured together by means of a suitable water proof glue such as Resorcinol Waterproof Glue (liquid resin). Screws may also be placed in the wall panels extending between the members to additionally reinforce the securing thereof.

This double laminated construction provides a more rigid and stronger construction for a given thickness of wall. The side walls are connected to the top panel by a stepped joint construction wherein the inner panel 22, as best seen in FIG. 2 for example, is secured against the butt end of side wall **30*a* and butted against the inner face of side wall portion 30*b*. The lid or top wall portion is also overlapping the side wall and end wall 30*b***. These joints are secured together by glue and by screws to insure a secure joint.

Figure 3:
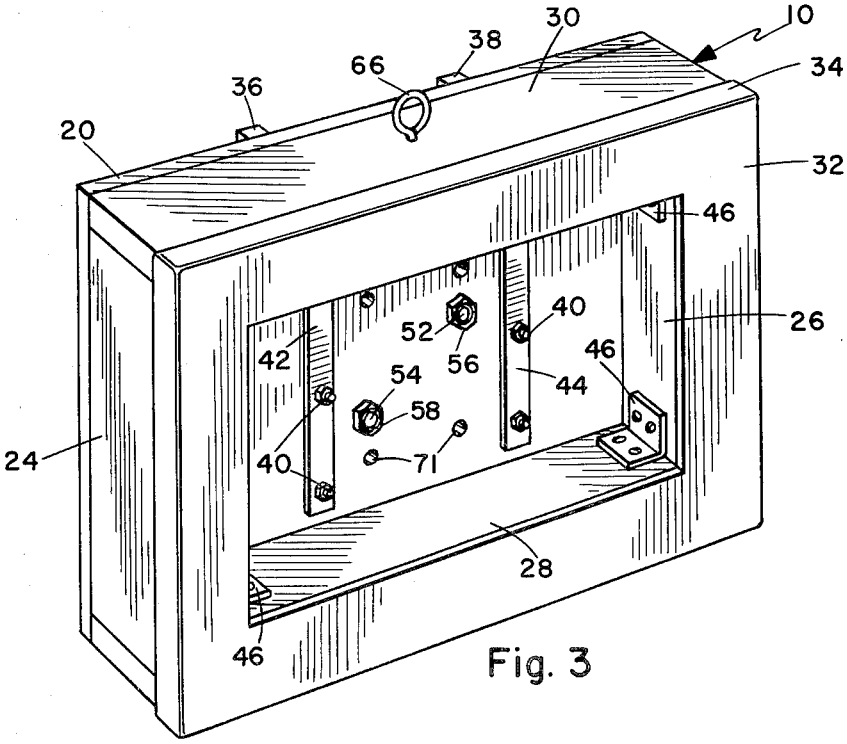
FIG. 3 is a perspective view showing the interior of a cofferdam.
Figure 4:
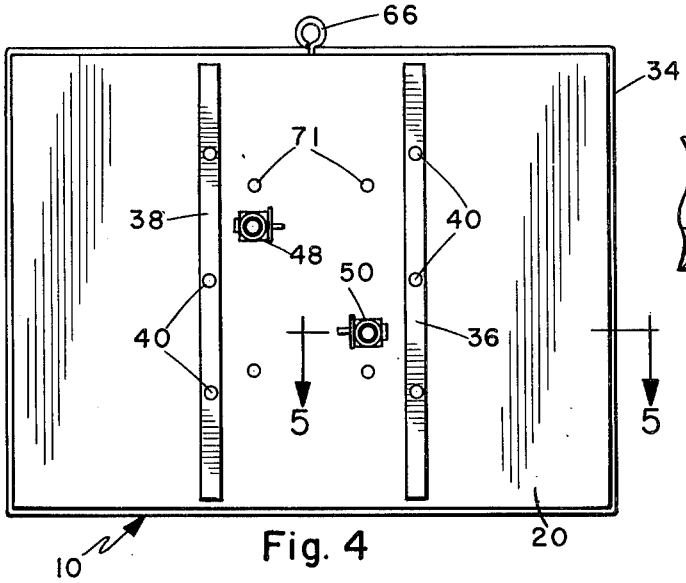
FIG. 4 is a rear elevational view of the structure of FIG. 3.
Figure 5:
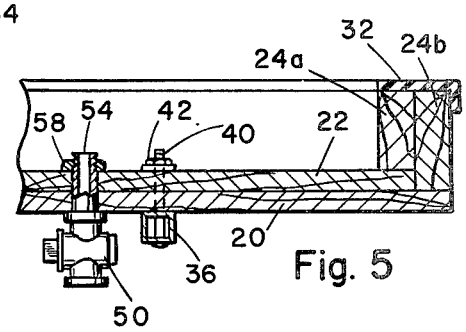
FIG. 5 is an enlarged sectional view taken on line 5—5 of FIG. 4.
Figure 6:
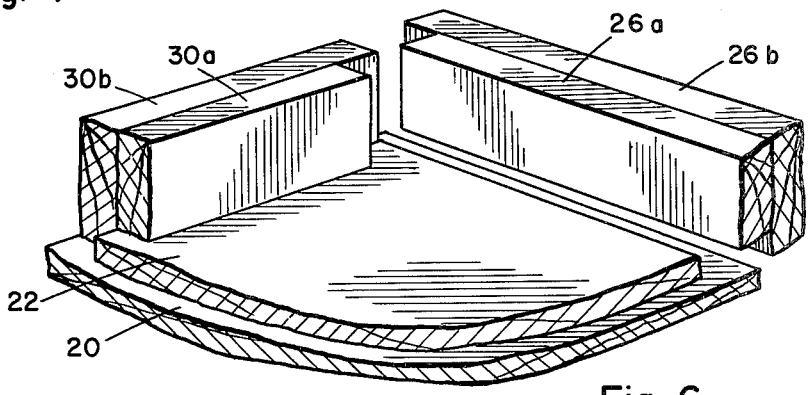
FIG. 6 is a perspective view with portions separated of a typical corner joint of the dam.

The side walls also join together with end walls as shown in FIG. 6 with a similar stepped joint. This again provides a high strength, durable joint wherein at least one surface of the joint is at right angles to another surface of the joint. Again, high strength glue and screws are utilized in securing the side panels and end panels together at the corners. The end walls and side wall combination, as shown in FIGS. 2 and 3 for example, provide a peripheral face which in many instances is shaped to conform to the curvature of the hull where necessary and includes a peripheral seal 32 of suitable sealing material, such as Rubatex neoprene rubber sheeting, which is secured by a suitable adhesive, such as Anchor Weld neoprene liquid glue, to the face, with an overlapping flange 34 for further enhancing the security of the seal to the sides and the end walls.

It should be noted that considerable pressure exists on the submerged surface of a vessel, depending on the depth of the surface in question. For this reason, a very high strength, durable construction is required. In many application, such as for the Department of the Navy, a safety factor of 500% is required. Additionally, the wood construction as illusrated provides a construction which is not only strong and durable, but has a certain amount of buoyancy in the water such that it can be fairly easily manipulated into position.

Additional strength as well as buoyancy is added to the cofferdam by means of a pair of hollow box beams 36 and 38 which are secured to the outside of the surface of the cofferdam by means of suitable fastening means, such as a plurality of bolts 40 which extend through the wall of the dam and are secured to straps or plates 42 and 44 on the inside face of the top panel. Additional reinforcement for the corners are provided by angle brackets 46 secured to the inside corners of the cofferdam.

The cofferdam is provided with a pumping valve 48 and a vent valve 50 each connected respectively by suitable conduit means 52 and 54 for communication inside the chamber or cavity defined by the cofferdam. The conduit means 52 and 54 are preferably small short sections of brass pipe or tubing connected into position by means of hex nuts 56 and 58 on the inside face of the top thereof. Suitable flexible conduit 60 and 62 connect the respective valves to a pump 64 for the pumping operation and to air vent or water vent, as required.

The cofferdam as illustrated and described above are for the purposes of closing of openings in the hull of a ship below the water line while the ship is at dock side, for permitting repairs to plumbing and the like inside the ship without the necessity of putting the ship in dry dock. Such cofferdams accordingly permit the ready and rapid repair of the vessel without the necessity of waiting in line for a dry dock. Such waits for dry dock can be several months in many busy ports. Accordingly the use of such cofferdams can considerably reduce the cost of repair to sea going vessels by eliminating the costly and expensive down time as well as the expensive movement of the ship into and out of dry dock.

In the use of the cofferdam, an opening in the vessel to be repaired is located by suibable markings or other indicia and a cofferdam is then supported over the side of the vessel by a suitable support structure, such as a boom and winch connected by a cable to a ring 66 on the top of the cofferdam. The coffer dam is lowered to the side of the vessel in line with the opening, and divers beneath the water guide the cofferdam into position. If the opening has grating or the like, as illustrated in FIG. 2, a plurality of J-bolts 68 and 70 are hooked around the grating or grill work of the opening and are passed through holes 71 to pull the cofferdam into tight sealing engagement with the hull of the ship by means of nuts 72 and 74 threadably engaging the end of the J-bolts. Where grill work is not available in the opening and the opening permits, an expanding dead man is used for hooking the J-bolts to, or an alternate rigging is provided as shown, for example, in FIG. 7.

Figure 7:
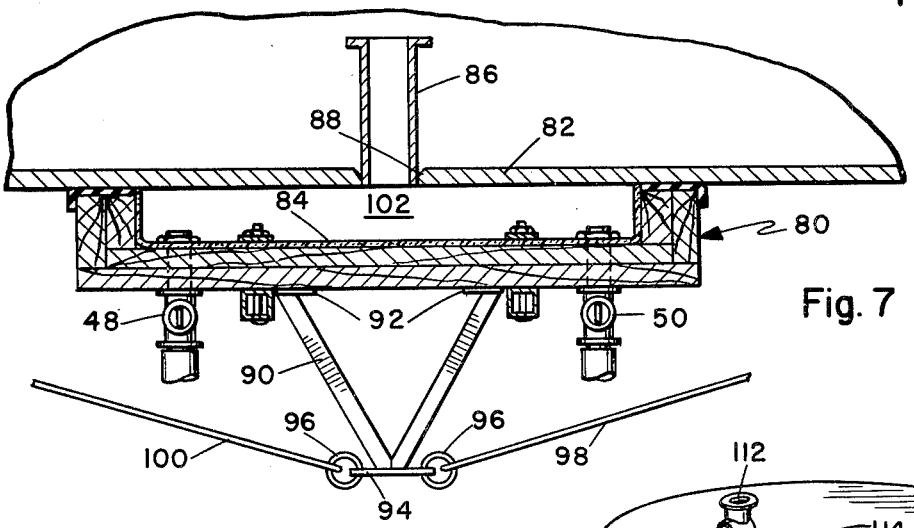
FIG. 7 is a sectional view similar to FIG. 2, but showing a stand off external attachment for the cofferdam.

Turning to FIG. 7, an alternate embodiment is illustrated wherein a cofferdam 80 constructed identical to that in the previous embodiment is selected and the appropriate curvature of the sealing area matched to a selected position on the wall of a vessel 82. This construction and the rigging is suitable for installations commonly referred to as a hot box, which is provided for the purpose of installing new plumbing or openings in the hull of a ship, or for removing old openings, for example, where welding and cutting of the hull is necessary.

The cofferdam when constructed of wood material as described above, is coated on the inside surface with a suitable flame retardant or the like, such as an asbestos lining 84. In the illustrated embodiment, the installation of the cofferdam is for the installation of a new sea chest or a boiler blow down, which comprises a tube 86 to be mounted in an opening 88 in the hull of wall 82 of the ship. Since no hole or grating exists for the cofferdam to be secured to, it is secured by a rigging commonly referred to as a hogging assembly. This rigging includes a stand off tower 90 of a generally pyramid configuration having inner feet 92 engaging the lid of the cofferdam and an outer bracket 94, including suitable rings or the like 96 for the connection of cables 98 and 100. The stand off tower must be sufficient in length or height to give a suitable angle of force to the cables to pull the cofferdam into tight engagement with the hull of the ship. As soon as the cofferdam is installed in place, the vent line is open to atmosphere and the pump line is opened and the pump pumps out the cavity defined by the walls of the cofferdam, providing an air space at 102. The opening 88 can then be cut in the wall of the vessel by a torch or the like, the tube 86 placed into position and welded. Valves 48 and 50 are spaced apart clear of the hot working area. With the cofferdam in place the tube 86 can then be sealed off internally and the weld and joint of the tube to the vessel hull be checked by flooding the space 102. This is accomplished simply by permitting water to flow back into the space by way of the vent valve. This permits a checking of the assembly under normal pressure. Should any failure occur or inadequacy of the structure be detected, such as a leak or the like, the cofferdam is simply left in place and evacuated again and the necessary repairs made.

Figure 8:
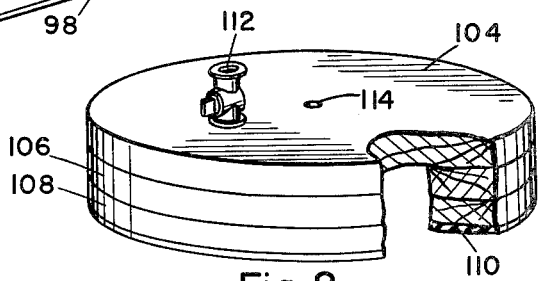
FIG. 8 is a perspective view partially cut away of a circular cofferdam.

An alternate construction of cofferdam is shown in FIG. 8. This construction is of a generally cylindrical housing having a circular lid 104 of laminated plywood construction secured to laminated annular side wall defined by a pair of or plurality of side wall ring members 106 and 108. A seal member 110 is provided at the face of the walls for sealing engagement with the ships hull. One or more vent or pumping valves 112 may be provided in the lid of the cofferdam for purposes of venting and evacuating the space therein. Additional openings for J-bolts and the like, such as 114, may be provided if necessary.

A cofferdam in accordance with this invention permits many rapid and safe repairs of a vessel at dock side. The air chamber of the cofferdam permits welding and cutting which would not otherwise be possible due to cooling and quenching by water. The chamber can also be pumped and thereby avoid the necessity of dumping the water from the sea chest into the ships bilge.

While I have described my invention by means of specific embodiments, it is to be understood that numerous changes and modifications may be made therein without departing from the spirit and scope of the invention as defined in the appended claims.

Having described my invention, I now claim:

1. A cofferdam for closing off underwater openings in ships' hulls, comprising:

a first wall constructed of a plurality of sheets of marine plywood laminated together having a generally planar configuration defining a stepped portion extending around the perimeter thereof, and dimensioned to exceed the area of an opening to be covered in a ship's hull;

a second wall constructed of multiple wooden beams laminated together defining a step extending along the entire length of said second wall, said second wall extending around the perimeter of, and at right angles to said first wall for engaging said ship's hull around said opening for spacing said first wall a predetermined distance from said ship's hull for defining a cavity therebetween;

said step and said stepped portion defining a stepped overlapping joint extending around the perimeter of and connecting said first wall and said second wall together at the intersection thereof;

seal means extending around the periphery of said second wall for sealing the engagement thereof with a ship's hull; and mounting means for securing said cofferdam to a ship's hull for covering an opening therein.

2. The cofferdam of claim 1, wherein said mounting means comprises a plurality of J-bolts extending through said first wall for anchoring the cofferdam to structure within said opening.

3. The cofferdam of claim 1, including conduit means communicating with said cavity and valve means for controlling communication of fluid through said conduit means.

4. The cofferdam of claim 3, including a pump connected to said conduit means for pumping water from said cavity.

5. The cofferdam of claim 1, including at least one reinforcing beam extending across the major dimension of said first wall, comprising a closedended hollow box beam.

6. The cofferdam of claim 1, wherein the inside walls of said dam are coated with a fire resistant material.

7. The cofferdam of claim 6, wherein the fire resistant material is asbestos.

8. The cofferdam of claim 7 including a pump conduit and a vent conduit communicating with said cavity, and a valve controlling each of said conduits.

9. The cofferdam of claim 6, wherein said first wall is circular in configuration and said second walls are annular in configuration.

10. The cofferdam of claim 6, wherein said first wall is generally rectangular in configuration.

11. A cofferdam for closing off underwater openings in ships' hulls, comprising:

a first wall constructed of at least an outer and an inner sheet of marine plywood, laminated together having a generally planar configuration, said inner sheet being of smaller dimension than said outer sheet for defining a stepped portion extending around the perimeter thereof and said wall being dimensioned to exceed the area of an opening to be covered in a ship's hull;

a second wall constructed of an inner and an outer wooden panel laminated together and extending around the perimeter of, and at right angles to said first wall for engaging said ship's hull around said opening for spacing said first wall a predetermined distance from said ship's hull, for defining a cavity therebetween, said inner panel having less height than said outer panel for defining a step extending around said second wall;

said step and said stepped portion defining a stepped overlapping joint extending around the perimeter of, and connecting said first wall and said second wall together at the intersection thereof;

seal means extending around the periphery of said second wall for sealing the engagement thereof with the ship's hull; and mounting means for securing said cofferdam to a ship's hull for covering an opening therein.

* * * * *